US011498348B2

(12) United States Patent
Sanada et al.

(10) Patent No.: US 11,498,348 B2
(45) Date of Patent: Nov. 15, 2022

(54) PRINTER DEVICE

(71) Applicant: TOSHIBA TEC KABUSHIKI KAISHA, Tokyo (JP)

(72) Inventors: Tsuyoshi Sanada, Susono Shizuoka (JP); Yuji Kawamorita, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 136 days.

(21) Appl. No.: 17/134,638

(22) Filed: Dec. 28, 2020

(65) Prior Publication Data

US 2021/0252884 A1 Aug. 19, 2021

(30) Foreign Application Priority Data

Feb. 14, 2020 (JP) ..... JP2020-023561

(51) Int. Cl.
*B41J 15/04* (2006.01)
*B41J 3/407* (2006.01)

(52) U.S. Cl.
CPC ..... *B41J 15/04* (2013.01); *B41J 3/4075* (2013.01)

(58) Field of Classification Search
CPC ..... B41J 13/00; B41J 13/0009; B41J 15/00; B41J 15/04; B41J 15/044; B41J 15/046; B41J 3/4075; B41J 15/042
See application file for complete search history.

(56) References Cited

U.S. PATENT DOCUMENTS

2005/0147450 A1* 7/2005 Sugimoto ..... B41J 15/046 400/613
2018/0297380 A1* 10/2018 Ikemoto ..... B41J 15/04
2019/0023037 A1* 1/2019 Nihashi ..... G06K 15/024

FOREIGN PATENT DOCUMENTS

JP 2013-047139 3/2013

* cited by examiner

*Primary Examiner* — Kristal Feggins
(74) *Attorney, Agent, or Firm* — Amin, Turocy & Watson, LLP

(57) ABSTRACT

A printer device includes a guide section, a first projecting section, and a second projecting section. The guide section is disposed to be opposed to a side surface of roll-like continuous paper and includes a guide surface for restricting movement of the continuous paper along a width direction of the continuous paper during conveyance of the continuous paper. The first projecting section is provided on the guide surface side of the guide section and rotatably holds a core section of the continuous paper. The second projecting section has an outer diameter larger than an outer diameter of the first projecting section and is movable between a supporting position where the second projecting section contains an outer circumference of the first projecting section and a storing position where the second projecting section is stored further on an inner side than the guide surface. In the supporting position, the second projecting section rotatably holds a core section of another continuous paper having a core diameter larger than a core diameter of the continuous paper.

20 Claims, 21 Drawing Sheets

PRINTER DEVICE

CROSS-REFERENCE TO RELATED APPLICATION

This application is based upon and claims the benefit of priority from Japanese Patent Application No. 2020-023561, filed on Feb. 14, 2020, the entire contents of which are incorporated herein by reference.

FIELD

Embodiments described herein relate generally to a printer device.

BACKGROUND

There has been a printer (hereinafter referred to as printer device) that prints on a recording medium, which roll-like continuous paper such as a label or a receipt. On the inside of the printer device, a housing section (hereinafter referred to as hopper), which houses and holds the continuous paper, rotatably supports the center (hereinafter referred to as core section) of a roll of the continuous paper. In the hooper, a supporting member supporting the core section includes a projection insertable into the inner circumference of the core section. For example, the hooper includes a pair of paper guides that restricts movement of the continuous paper along the width direction of the continuous paper. The supporting member is provided in each of the pair of paper guides. The pair of paper guides is opposed to two side surfaces in the continuous paper and provided in the hopper to be capable of moving in association in the width direction of the continuous paper. Consequently, the pair of paper guides supports the core section to align the center portion in the width direction of the continuous paper with the center portion of a printing region in the printer device.

As the inner diameter of the core section of the continuous paper, there are several kinds of diameters such as 1 inch (approximately 25.4 mm), 1.5 inches (approximately 38 mm), and 42 mm. Accordingly, with the hopper having the configuration explained above, it is necessary to prepare, as many as the kinds of the inner diameters of core sections, supporting members (bosses) supporting the core section of the continuous paper and replace the supporting members according to continuous paper in use. Therefore, replacement work is complicated.

DETAILED DESCRIPTION

An aspect of embodiments is to provide a printer device adaptable to a plurality of continuous papers having different inner diameters of core sections.

A printer device according to an embodiment includes a guide section, a first projecting section, and a second projecting section. The guide section is disposed to be opposed to a side surface of roll-like continuous paper and includes a guide surface for restricting movement of the continuous paper along a width direction of the continuous paper during delivery of the continuous paper. The first projecting section is provided on the guide surface side of the guide section and rotatably holds a core section of the continuous paper. The second projecting section has an outer diameter larger than an outer diameter of the first projecting section and is movable between a supporting position where the second projecting section contains an outer circumference of the first projecting section and a storing position where the second projecting section is stored further on an inner side than the guide surface. In the supporting position, the second projecting section rotatably holds a core section of another continuous paper having a core diameter larger than a core diameter of the continuous paper.

First Embodiment

Figure 1:
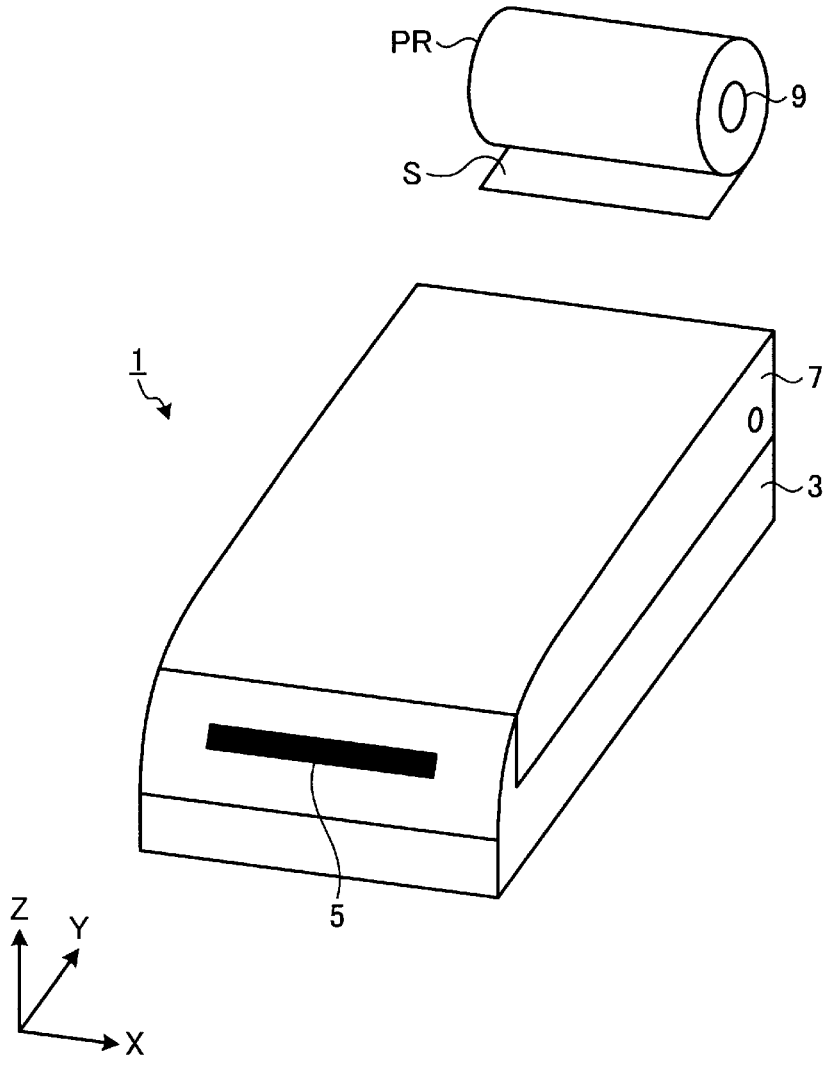
FIG. 1 is a diagram illustrating an example of the exterior of a printer device according to a first embodiment.

A first embodiment is explained with reference to the drawings. FIG. 1 is a diagram illustrating the exterior of a printer device 1 according to the first embodiment. In the following explanation, an orthogonal coordinate system formed by an X axis, a Y axis, and a Z axis is used. In FIG. 1, directions indicated by arrows are plus directions. An X-axis plus direction is the left direction and an X-axis minus direction is the right direction. A Y-axis plus direction is the rear direction (the rear side of the printer device 1) and a Y-axis minus direction is the front direction (the front side of the printer device 1). A Z-axis plus direction is an upward direction and a Z-axis minus direction is a downward direction. The front is a side on which a user is located.

The exterior of the printer device 1 includes a lower cover 3, a discharge port 5 for discharging continuous paper S, and an upper cover 7. Roll paper PR can be inserted into the inside of the printer device 1.

The roll paper PR is a roll-like printing medium (referred to as recording medium as well) obtained by winding the continuous paper S on a hollow core section 9. The core section 9 is equivalent to a tubular portion in the roll center of the continuous paper S. The roll paper PR is, for example, a receipt roll or a label roll. The receipt roll is wound belt-like continuous paper S to be receipts. The label roll is, for example, wound labels (label paper) with liner obtained by sticking labels to the belt-like continuous paper S. The printer device 1 pulls out the continuous paper S from the roll paper PR and prints information such as transaction details on the continuous paper S.

Figure 2:
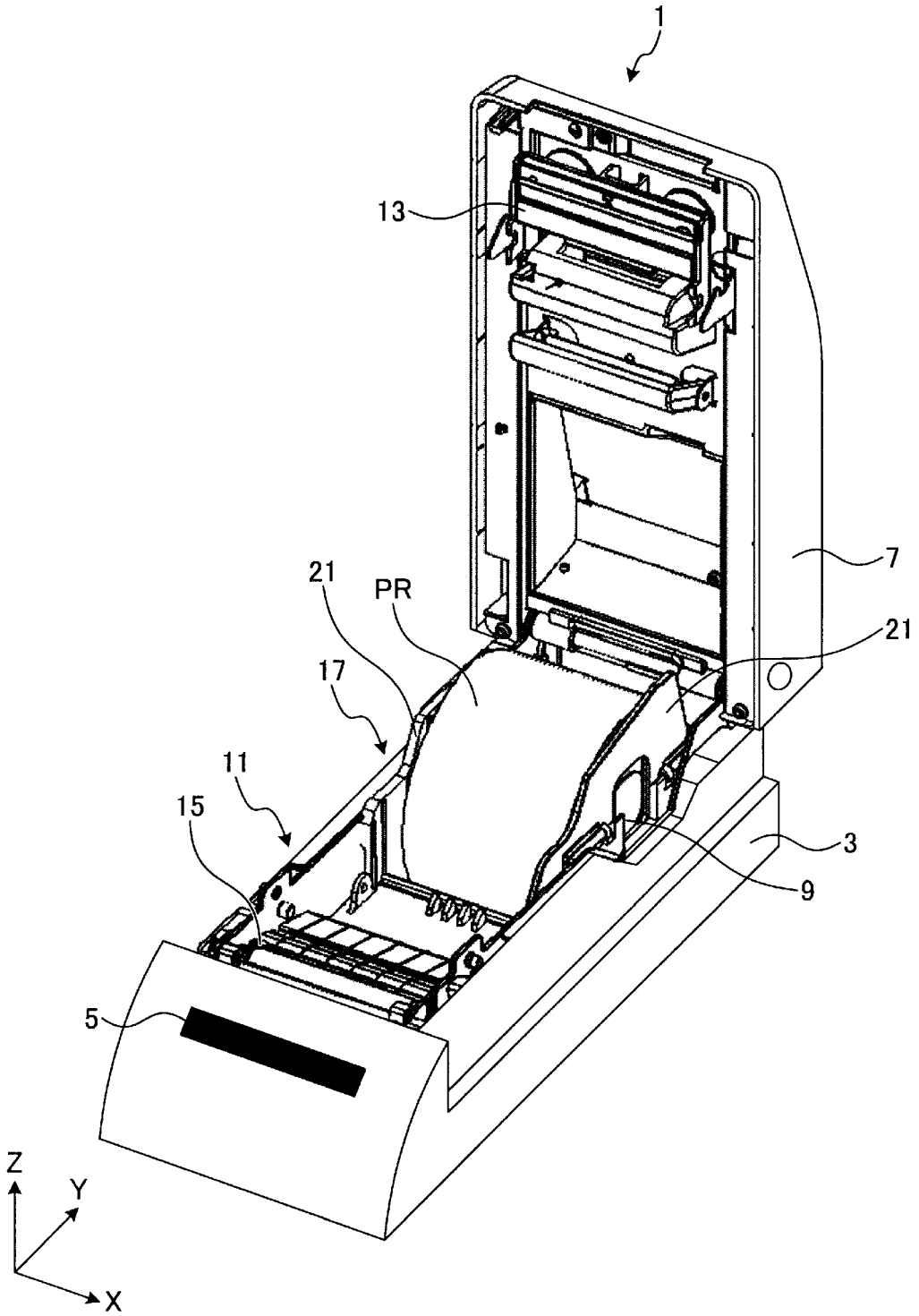
FIG. 2 is a diagram illustrating a state in which an upper cover of the printer device is opened.

FIG. 2 is a diagram illustrating a state in which the upper cover 7 of the printer device 1 is opened. The printer device 1 includes a printer main body 11, a thermal head 13, a platen roller 15, and a housing section 17. As illustrated in FIGS. 1 and 2, the lower cover 3 and the upper cover 7 cover the printer main body 11 and the housing section 17.

The lower cover 3 is a rectangular parallelepiped case, the upper surface of which is opened. A substantially upper surface of the printer main body 11 can be opened and closed by the upper cover 7. In the lower cover 3, a connection terminal (not illustrated) used for connection of the printer main body 11 on the inside and an external device, a power supply terminal (not illustrated) for supplying electric power to the printer main body 11, and the like are provided.

The discharge port 5 is provided on the front surface of the lower cover 3. The discharge port 5 is opened in the horizontal direction to discharge the continuous paper S in the front of the printer device 1. The exterior illustrated in FIG. 1 is only an example. Various modifications of the exterior are possible.

The upper cover 7 is attached to the lower cover 3 to be capable of turning with the X-axis direction as a rotation axis on one side on the rear side in the upper cover 7. The upper cover 7 opens and closes the opening of the upper surface of the lower cover 3 according to the turning around the rotation axis.

The thermal head 13 is fixed to, for example, the inner surface of the upper cover 7. In a state in which the opening on the upper surface of the lower cover 3 is closed by the upper cover 7, the thermal head 13 closely adheres to the platen roller 15. The thermal head 13 includes a plurality of heat generating bodies provided in parallel. The thermal head 13 prints, with heat of the heat generating bodies, on paper held between the thermal head 13 and the platen roller 15.

The platen roller 15 rotates with a driving force of a stepping motor (not illustrated) transmitted thereto and conveys the paper held between the platen roller 15 and the thermal head 13.

Figure 3:
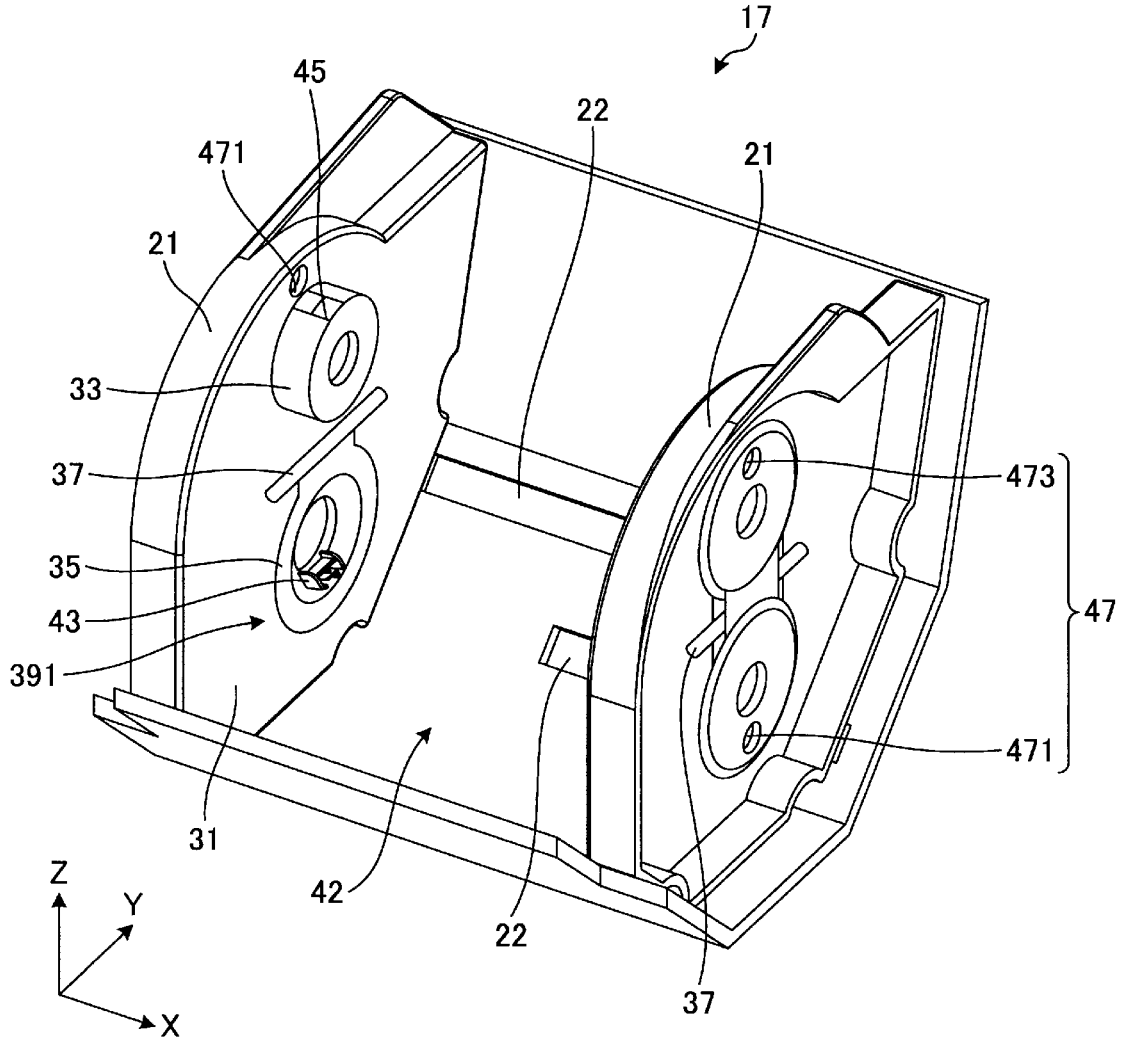
FIG. 3 is a diagram illustrating an example of a housing section.

The configuration and the operation of the housing section 17 in the first embodiment are explained below with reference to FIGS. 2 to 7. FIG. 3 is a diagram illustrating an example of the housing section 17. The housing section 17 is a container opened on the upper surface that houses and holds the roll paper PR. The housing section 17 detachably houses the roll-like continuous paper S including the hollow core section 9. The housing section 17 includes a pair of guide sections 21 and a rack and pinion.

The pair of guide sections 21 is a member forming the side wall of the housing section 17. The pair of guide sections 21 is disposed to be opposed to the side surfaces of the roll paper PR, which is the roll-like continuous paper S. The pair of guide sections 21 is movable by the rack and pinion in directions in which the pair of guide sections 21 approaches and separates from each other. The guide section 21 includes a guide surface 31. The guide surface 31 is a surface that restricts movement of the continuous paper S along the width direction of the continuous paper S during delivery of the continuous paper S. In the guide section 21, a first projecting section 33, a second projecting section 35, a holding section 43, and a plurality of openings 47 are provided.

The rack and pinion is configured by a pair of rack gears 22 and a pinion gear that meshes with the pair of rack gears 22. The pair of rack gears 22 is parallel to each other and tooth surfaces thereof are opposed. The pair of guide sections 21 holds the roll paper PR from both side ends to thereby press the roll paper PR not to move in the width direction (the X direction). According to the movement of the pair of guide sections 21 along the X direction via the rack and pinion, the roll paper PR is positioned with the width direction center as a reference.

Figure 4:
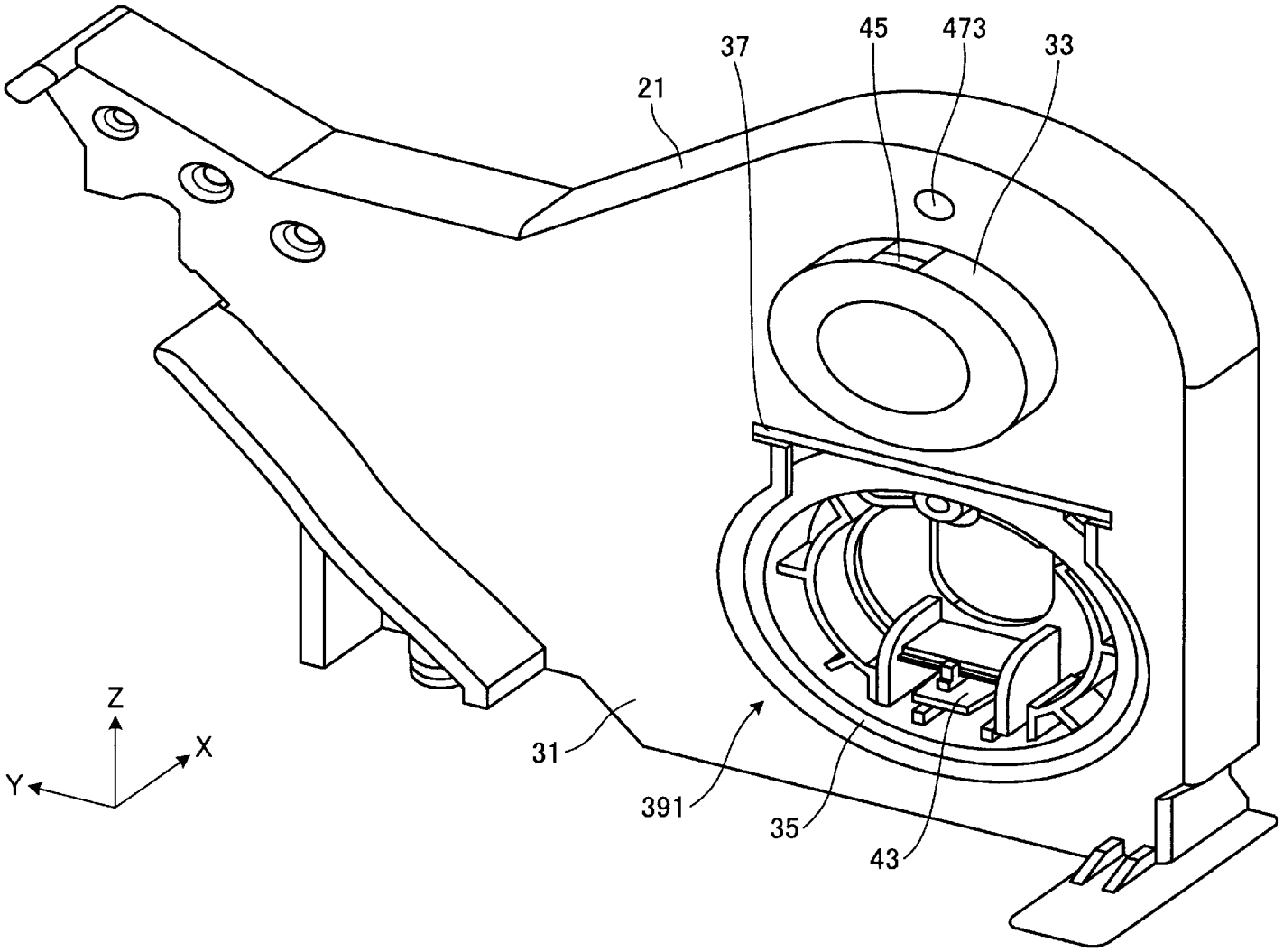
FIG. 4 is a diagram illustrating one guide section of a pair of guide sections and an example of the one guide section.
Figure 5:
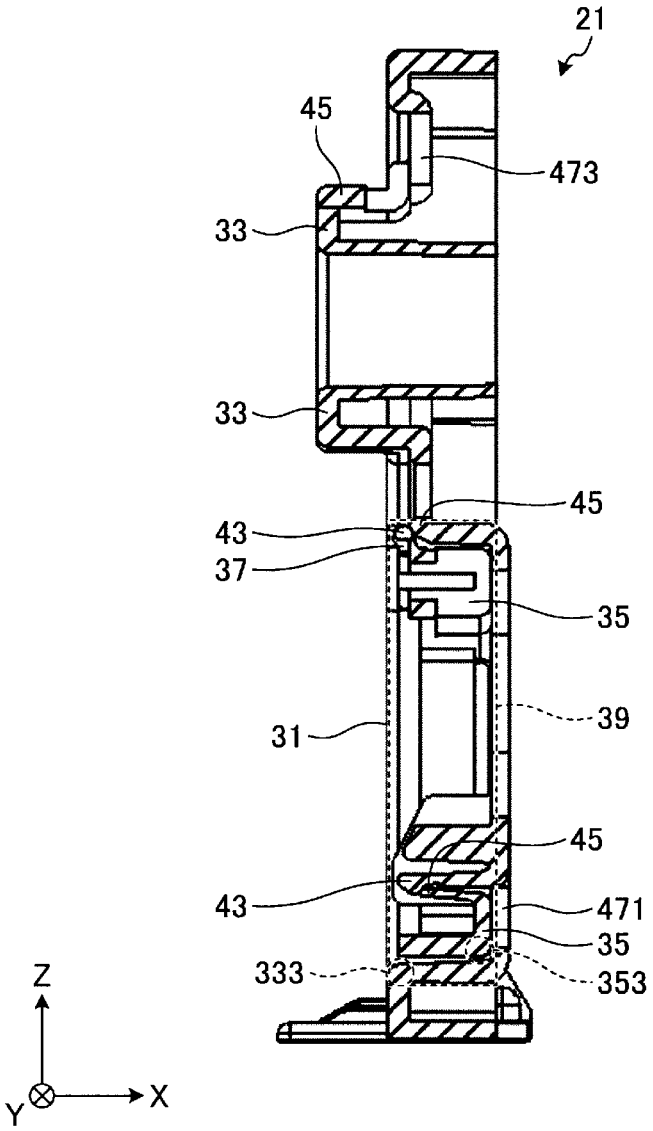
FIG. 5 is a diagram illustrating an example of an XZ section of the guide section illustrated in FIG. 4.

FIG. 4 is a diagram illustrating an example of one guide section 21 of the pair of guide sections 21. FIG. 5 is a diagram illustrating an example of an XZ section of the guide section 21 in FIG. 4. As illustrated in FIGS. 3 to 5, the first projecting section 33 is provided on the guide surface side of the guide section 21. The first projecting section 33 projects in a convex shape from the guide surface 31 toward the other guide section 21 disposed to be opposed to the guide section 21. The first projecting section 33 rotatably holds the core section 9 of the continuous paper S. The first projecting section 33 is a portion that penetrates into the core section 9, which is a tubular portion in the roll center of the roll paper PR. The first projecting section 33 has an external shape fit in the core section 9 (a paper tube). If the first projecting section 33 holds the core section 9, the first projecting section 33 receives a load from the roll paper PR. The core portion of the continuous paper S fit in the outer diameter of the first projecting section 33 and held by the first projecting section 33 is hereinafter referred to as first core section.

The second projecting section 35 has an outer diameter larger than the outer diameter of the first projecting section 33 and a hollow structure containing the first projecting section 33. The second projecting section 35 in this embodiment is referred to as annular second projecting section. The annular second projecting section 35 is supported by the guide section 21 via a rotation axis 37 along the Y-axis direction. In FIGS. 3 to 5, the annular second projecting section 35 is disposed in a storing section 39. The storing section 39 is provided below the first projecting section 33 on the guide surface 31. The storing section 39 includes a concave region from a region (hereinafter referred to as housing region) 42 where the roll paper PR is housed in the housing section 17 toward the outside (referred to as housing outside) of the housing region 42. A boundary between the housing region 42 and the housing outside corresponds to the guide surface 31.

Specifically, the storing section 39 has a concave shape corresponding to the shape of the annular second projecting section 35. The depth along the X direction of the concave shape is substantially equal to the height of the annular second projecting section 35. In the following explanation, the position of the annular second projecting section 35 disposed in the storing section 39 is referred to as storing position 391. In other words, the storing position 391 is equivalent to a position where the annular second projecting section 35 is stored further on the inner side than the guide surface 31. If the annular second projecting section 35 is disposed in the storing position 391, as illustrated in FIGS. 3 to 5, the outer circumference (hereinafter referred to as first outer circumference) of the first projecting section 33 is opened and the first projecting section 33 changes to a state in which the first projecting section 33 is capable of supporting the first core section. The annular second projecting section 35 is capable of turning around the rotation axis 37. The annular second projecting section 35 is movable between a position (hereinafter referred to as supporting position) 41 where the annular second projecting section 35 contains the first outer circumference and the storing position 391. In the supporting position 41, the annular second projecting section 35 projects in a convex shape from the guide surface 31 toward the other guide section 21 disposed to be opposed to the guide section 21.

Figure 6:
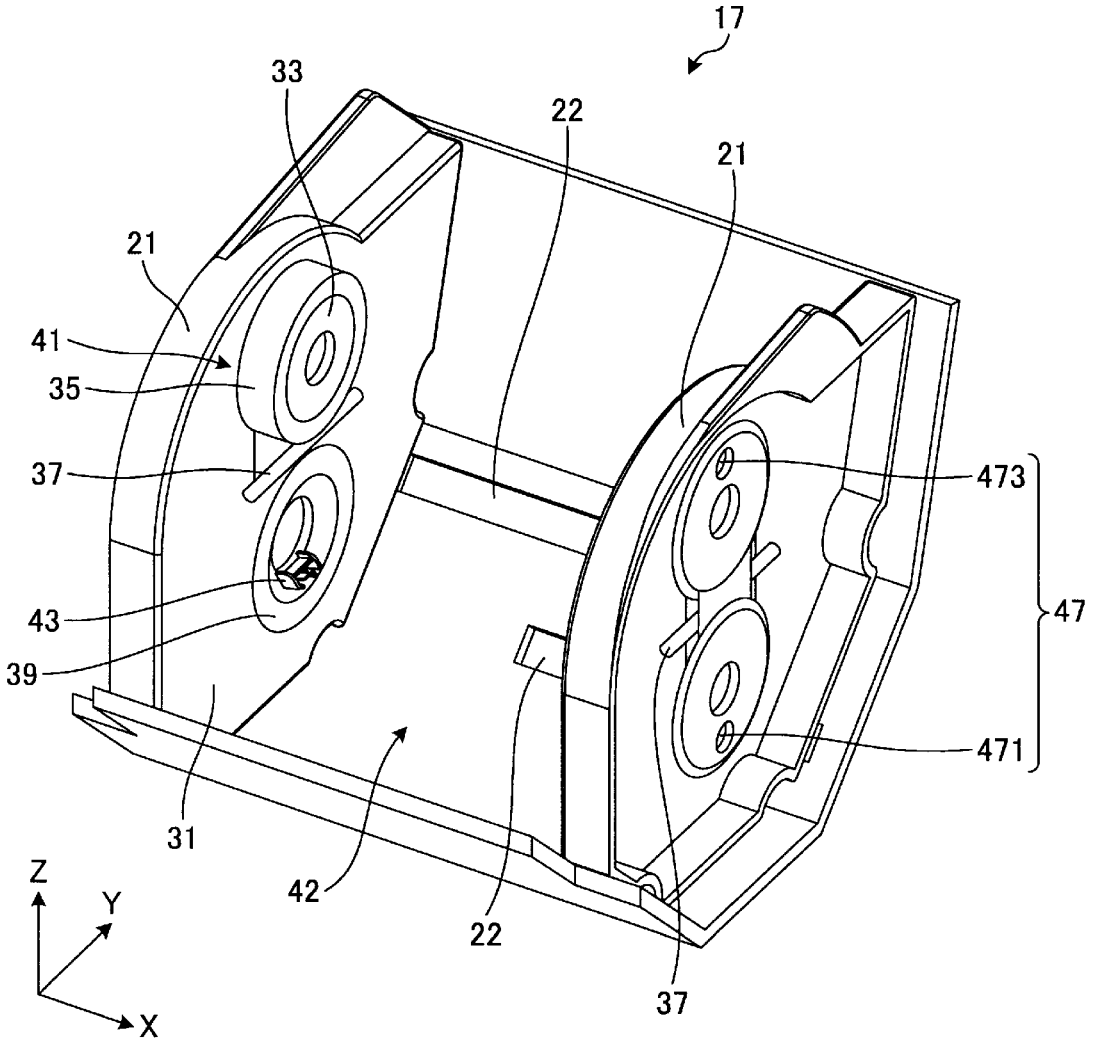
FIG. 6 is a diagram illustrating an example of an annular second projecting section moved from a storing position to a supporting position in FIG. 3.
Figure 7:
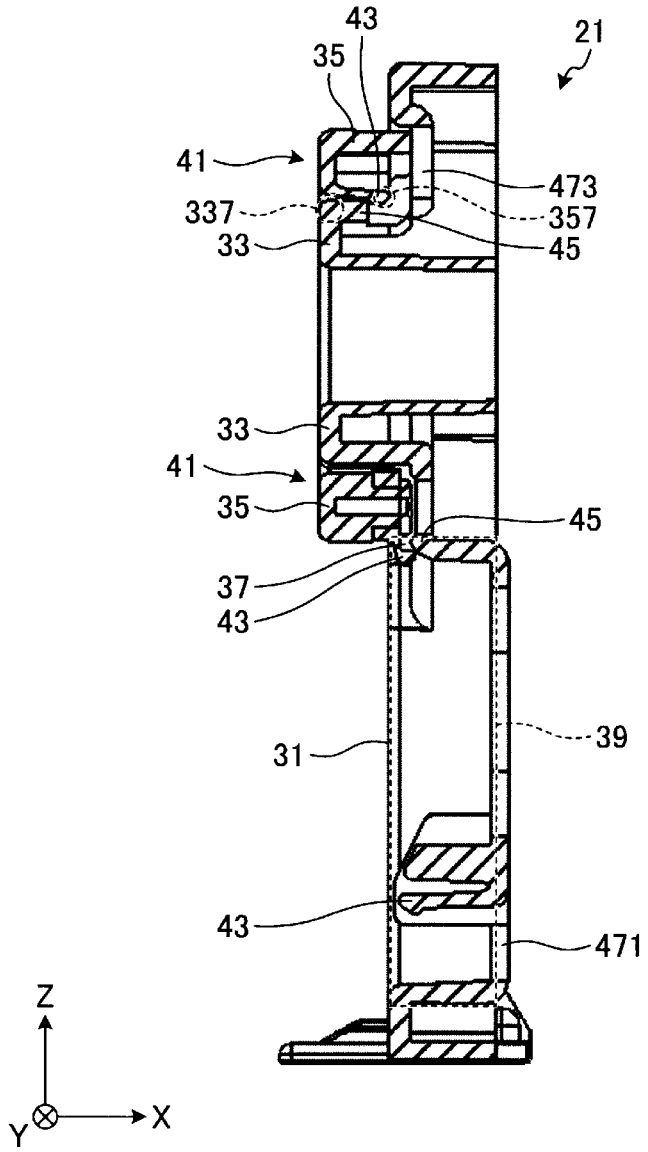
FIG. 7 is a diagram illustrating an example of the XZ section of the guide section illustrated in FIG. 6.

FIG. 6 is a diagram illustrating an example of the annular second projecting section 35 moved from the storing position 391 to the supporting position 41 in FIG. 3. FIG. 7 is a diagram illustrating an example of the XZ section of the guide section 21 in FIG. 6. As illustrated in FIGS. 6 and 7, if the annular second projecting section 35 is disposed in the supporting position 41, the distal end portion of the first projecting section 33 and the distal end portion of the annular second projecting section 35 are located in substantially the same surface parallel to the guide surface 31 and are in a flat state with respect to the guide surface 31. That is, the distance (hereinafter referred to as first projection distance) from the guide surface 31 to the distal end portion of the first projecting section 33 and the distance (hereinafter referred to as second projection distance) from the guide surface 31 to the distal end portion of the annular second projecting section 35 in the supporting position 41 are substantially the same. In the supporting position 41, the annular second projecting section 35 is capable of rotatably holding a core section (hereinafter referred to as second core section) of another continuous paper having a core diameter larger than the core diameter of the continuous paper S supported by the first projecting section 33.

For example, if the outer diameter of the first projecting section 33 is 1 inch and the outer diameter of the annular second projecting section 35 is 1.5 inches, in the supporting position 41, the annular second projecting section 35 rotatably holds a second core section having an inner diameter corresponding to 1.5 inches. That is, the first projecting section 33 is used to hold the first core section and the annular second projecting section 35 is used to hold the second core section.

As illustrated in FIGS. 3 to 7, the holding section 43 holds the annular second projecting section 35 in the storing position 391 or the supporting position 41. A total number of holding sections 43 provided in the storing position 391 and the supporting position 41 in the guide section 21 may be any number. The holding section 43 provided in the guide section 21 is realized as, for example, an elastic body having a predetermined elastic force or an engaging claw engageable with a section to be engaged 45 provided in the first projecting section 33 and the annular second projecting section 35. That is, the holding section 43 functions as a stopper that fixes (locks) the annular second projecting section 35 disposed in the storing position 391 or the supporting position 41 not to move.

If a contact surface in contact with the first outer circumference and the surface of the first outer circumference are parallel to the X axis in the annular second projecting section 35 and the surface of the outer circumference (hereinafter referred to as second outer circumference) in the annular second projecting section 35 and a contact surface in contact with the second outer circumference in the storing position 391 are parallel to the X axis, the holding section 43 in the guide section 21 may be omitted. In this case, in the supporting position 41 illustrated in FIG. 7, an end portion (hereinafter referred to as first end portion) 337 most distant from the rotation axis 37 on the surface of the first circumference functions as a stopper for an end portion (hereinafter referred to as opposed end portion) 357 of the annular second projecting section 35 most distant from the rotation axis 37 and opposed to the guide surface 31. More in detail, a rotation radius from the rotation axis 37 to the opposed end portion 357 is short compared with the distance from the rotation axis 37 to the first end portion 337. Accordingly, if the annular second projecting section 35 is moved to the supporting position 41, the first end portion 337 locks the opposed end portion 357.

If the holding section 43 is omitted, in the storing position 391 illustrated in FIG. 5, a position (hereinafter referred to as concave end portion) 333 opposed to the guide surface 31 in the storing section 39 and most distant from the rotation axis 37 functions as a stopper for an end portion (hereinafter referred to as second end portion) 353 most distant from the rotation axis 37 on the surface of the second outer circumference. More in detail, a rotation radius from the rotation axis 37 to the concave end portion 333 is short compared with the distance from the rotation axis 37 to the second end portion 353. Accordingly, if the annular second projecting section 35 is moved to the storing position 391, the concave end portion 333 locks the second end portion 353.

If the annular second projecting section 35 is present in the storing position 391, the outer circumference of the first projecting section 33 is opened as illustrated in FIGS. 3 to 5. In this case, the first core section matching the outer diameter of the first projecting section 33 is insertable into the first projecting section 33. In this case, as illustrated in FIGS. 3 and 4, the annular second projecting section 35 is stored in the storing position 391 and held by the holding section 43.

The guide section 21 includes the opening 47 through which the annular second projecting section 35 is accessible from the outside of the guide section 21 in the storing position 391 and the supporting position 41. The user is capable of accessing the annular second projecting section 35 disposed in the storing position 391 from the outside of the guide section 21 via an opening (hereinafter referred to as storing opening) 471 provided in the storing position 391. The access is equivalent to operation such as push-out of the annular second projecting section 35 from the storing opening 471 to the housing region 42. The holding of the annular second projecting section 35 by the holding section 43 is released by the access to the annular second projecting section 35 via the storing opening 471. Consequently, the annular second projecting section 35 is capable of turning around the rotation axis 37. The annular second projecting section 35, the holding of which by the holding section 43 is released, is turned to the supporting position 41 in the housing region 42 according to operation by the user. Consequently, the annular second projecting section 35 is moved to the supporting position 41 and held by the holding section 43 as illustrated in FIG. 7.

The user is capable of accessing the annular second projecting section 35 disposed in the supporting position 41 from the outside of the guide section 21 via an opening (hereinafter referred to as supporting opening) 473 provided in the supporting position 41. The access is equivalent to operation such as push-out of the annular second projecting section 35 from the supporting opening 473 to the housing region 42. The holding of the annular second projecting section 35 by the holding section 43 is released by the access to the annular second projecting section 35 via the supporting opening 473. The annular second projecting section 35, the holding of which by the holding section 43 is released, is turned to the storing position 391 in the housing region 42 according to operation by the user. Consequently, the annular second projecting section 35 is moved to the storing position 391 and held by the holding section 43 as illustrated in FIGS. 3 to 5.

In the above explanation, the movement of the annular second projecting section 35 in the storing position 391 and the supporting position 41 is realized by the rotation around the rotation axis 37. However, not only this, but the movement of the annular second projecting section 35 in the storing position 391 and the supporting position 41 may be realized by translating the annular second projecting section 35 along the X-axis direction and the Z-axis direction. In the above explanation, the annular second projecting section 35 is one section. However, not only this, but the annular second projecting section 35 may be realized by a concentric plurality of projecting sections. In this case, the storing position 391 and the supporting position 41 are provided in the guide section 21 in a telescopic structure according to each of the plurality of projecting sections concentric with the first projecting section 33.

As explained above, the printer device 1 according to the first embodiment includes the annular second projecting section 35 having the outer diameter larger than the outer diameter of the first projecting section 33 and rotatably holding the core section of the other continuous paper having the core diameter larger than the core diameter of the continuous paper S supported by the first projecting section 33. The annular second projecting section 35 is movable between the supporting position 41 and the storing position 391. Consequently, the printer device 1 according to the first embodiment can selectively use a plurality of projecting sections (for example, the first projecting section 33 and the annular second projecting section 35) according to a plurality of roll papers having different inner diameters of core sections. With the printer device 1 according to the first embodiment, the first projection distance and the second projection distance can be set substantially the same, that is, the distal end of the projection in the first projecting section 33 and the distal end of the projection in the annular second projecting section 35 in the supporting position 41 can be made flush with each other. Consequently, it is possible to stably support the core section during use of each of the first projecting section 33 and the annular second projecting section 35. It is possible to freely move the annular second projecting section 35 without interfering with the first projecting section 33.

Consequently, with the printer device 1 according to the first embodiment, it is unnecessary to prepare and store, according to the inner diameters of core sections of continuous papers, a plurality of supporting members (projecting sections) having different outer diameters. It is possible to cope with a plurality of continuous papers having different inner diameters of core sections with simple operation. In addition, with the printer device 1 according to the first embodiment, a core section can be supported using a projecting section matching the inner diameter of the core section. Accordingly, it is possible to suppress swinging of roll paper in a direction different from the X axis during conveyance of continuous paper. It is possible to stably convey the continuous paper.

Modification

In a modification of the first embodiment, a second projecting section has, in the supporting position 41, a concave shape covering the first projecting section 33. The second projecting section in this modification is referred to as covering second projecting section. The modification of the first embodiment is explained below with reference to FIGS. 8 to 10.

Figure 8:
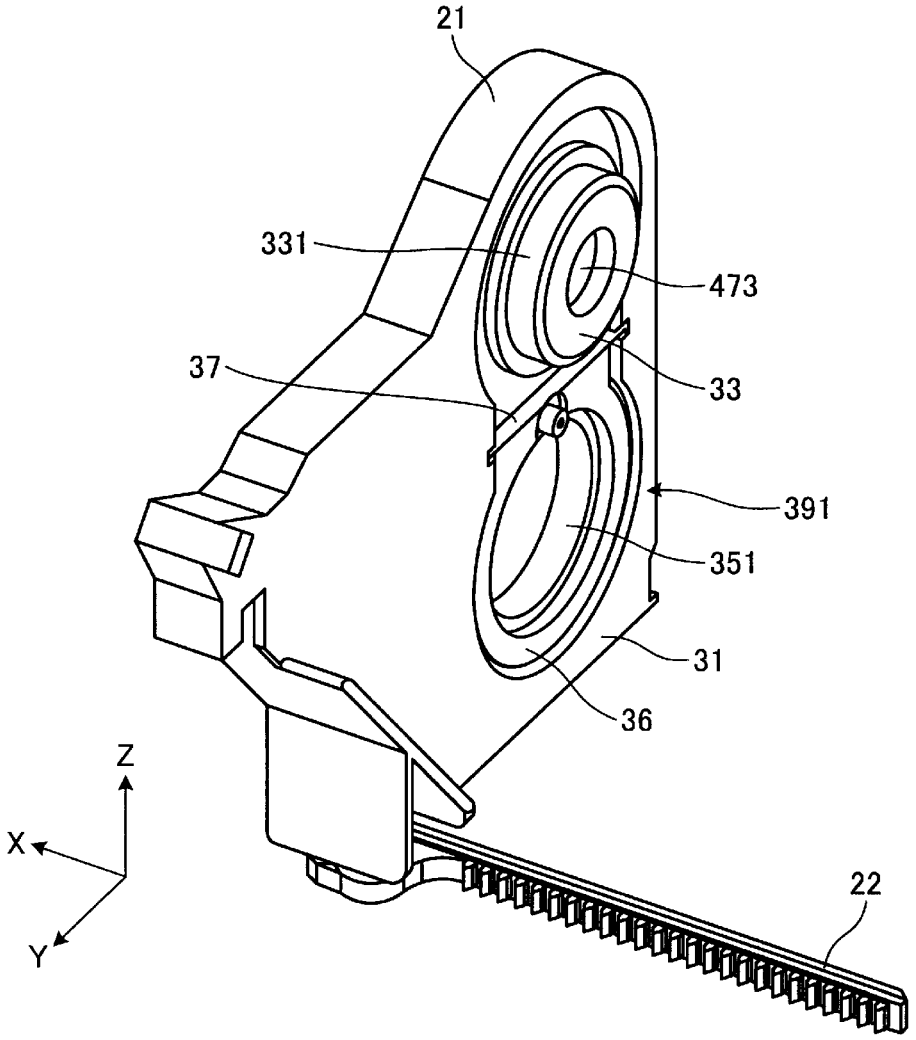
FIG. 8 is a diagram relating to a modification of the first embodiment and illustrating an example of a covering second projecting section held in the storing position and a state in which an outer circumference of a first projecting section is opened.

FIG. 8 is a diagram illustrating an example of a covering second projecting section 36 held in the storing position 391 and a state in which the outer circumference of the first projecting section 33 is opened. As illustrated in FIG. 8, the covering second projecting section 36 has a concave shape capable of covering the first projecting section 33. As illustrated in FIG. 8, in the covering second projecting section 36, a contact surface 351 in contact with the outer circumference of the first projecting section 33 and a surface 331 of the outer circumference of the first projecting section 33 are parallel to the X axis. Therefore, the holding section 43 in the guide section 21 is not mounted. In the modification of the first embodiment, the holding section 43 may be provided in the guide section 21.

Figure 9:
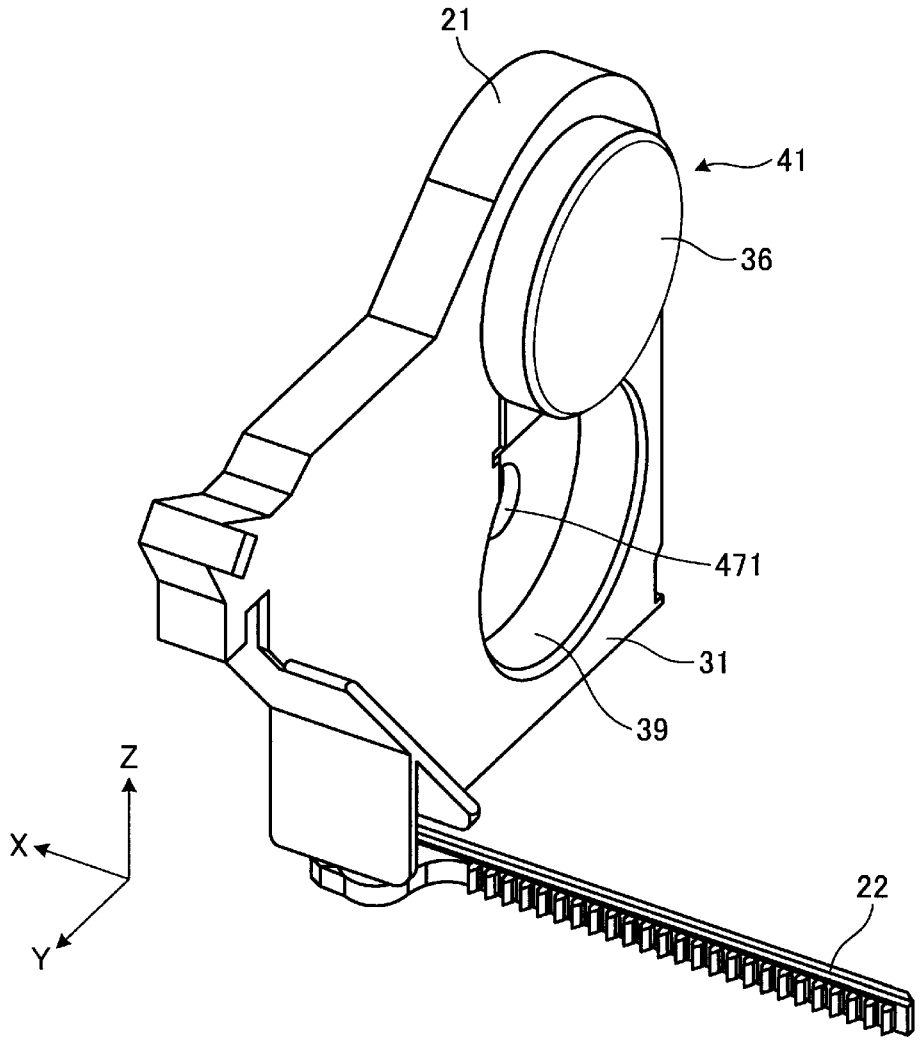
FIG. 9 is a diagram relating to the modification of the first embodiment and illustrating an example of the covering second projecting section held in the supporting position.

FIG. 9 is a diagram illustrating an example of the covering second projecting section 36 held in the supporting position 41. As illustrated in FIG. 9, in the supporting position 41, the covering second projecting section 36 covers the first projecting section 33. The storing section 39 in this modification has a concave shape corresponding to the shape of the covering second projecting section 36. The depth along the X direction of the concave shape is substantially equal to the height of the covering second projecting section 36.

Figure 10:
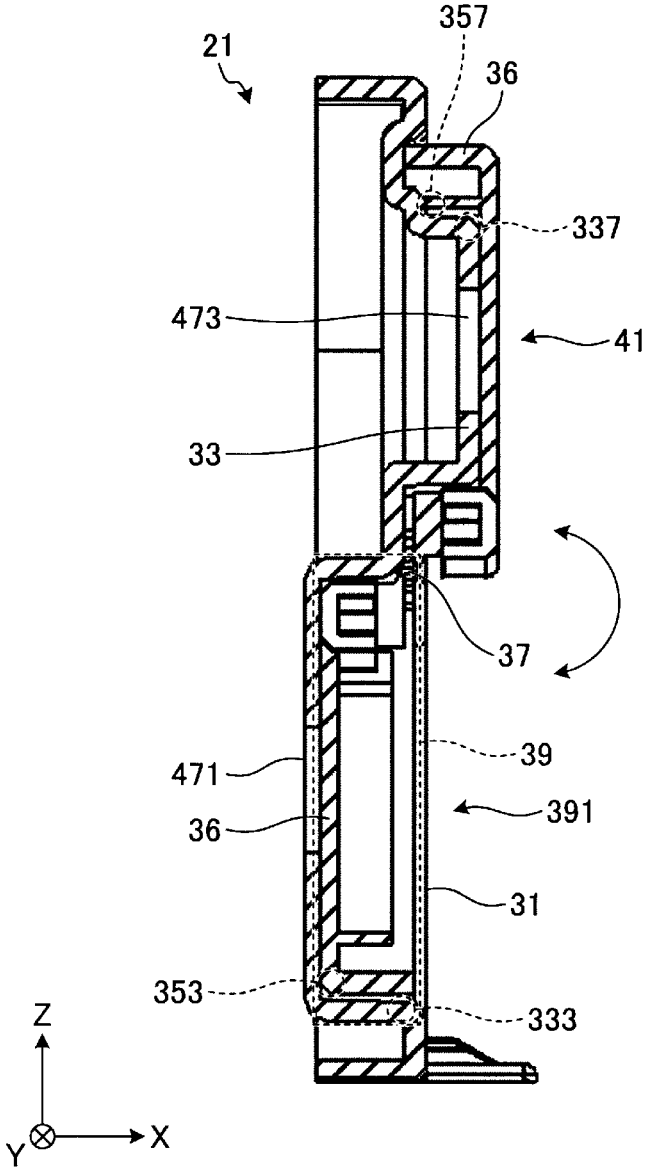
FIG. 10 is a diagram relating to the modification of the first embodiment and illustrating an example of the XZ section of the guide section in FIGS. 8 and 9.

FIG. 10 is a diagram illustrating an example of the XZ section of the guide section 21 in FIGS. 8 and 9. In FIG. 10, for convenience of explanation, the covering second projecting section 36 is illustrated in each of the supporting position 41 and the storing position 391. In FIG. 10, the user is capable of accessing the covering second projecting section 36 disposed in the storing position 391 from the outside of the guide section 21 via the storing opening 471. Lock of the second end portion 353 by the concave end portion 333 is released by the access to the covering second projecting section 36 via the storing opening 471. Consequently, the covering second projecting section 36 is capable of turning around the rotation axis 37. The unlocked covering second projecting section 36 is turned from the storing position 391 toward the supporting position 41 in the housing region 42 according to operation by the user as indicated by an arrow in FIG. 10. In the supporting position 41, the opposed end portion 357 is locked by the first end portion 337. According to the operation explained above, the covering second projecting section 36 stored in the storing position 391 illustrated in FIG. 8 is moved to the supporting position 41 illustrated in FIG. 9. Subsequently, the covering second projecting section 36 is locked in the supporting position 41 illustrated in FIG. 9.

In FIG. 10, the user is capable of accessing the covering second projecting section 36 disposed in the supporting position 41 from the outside of the guide section 21 via the supporting opening 473. The lock of the opposed end portion 357 by the first end portion 337 is released by the access to the covering second projecting section 36 via the supporting opening 473. Consequently, the covering second projecting section 36 is capable of turning around the rotation axis 37. The unlocked covering second projecting section 36 is turned from the supporting position 41 toward the storing position 391 in the housing region 42 according to operation by the user as indicated by an arrow in FIG. 10. In the storing position 391, the second end portion 353 is locked by the concave end portion 333. According to the operation explained above, the covering second projecting section 36 disposed in the supporting position 41 illustrated in FIG. 9 is moved to the storing position 391 illustrated in FIG. 8. Subsequently, the covering second projecting section 36 is locked in the supporting position 41 illustrated in FIG. 8. Action effects in the modification of the first embodiment are the same as the action effects in the first embodiment. Therefore, explanation of the action effects is omitted.

Second Embodiment

In a second embodiment, a second projecting section (hereinafter referred to as U-shaped second projecting section) having a U shape capable of forming a circular outer edge in conjunction with the first projecting section 33 rotatably holds a second core section in conjunction with the first projecting section 33. The second embodiment is explained below with reference to FIGS. 11 to 15.

Figure 11:
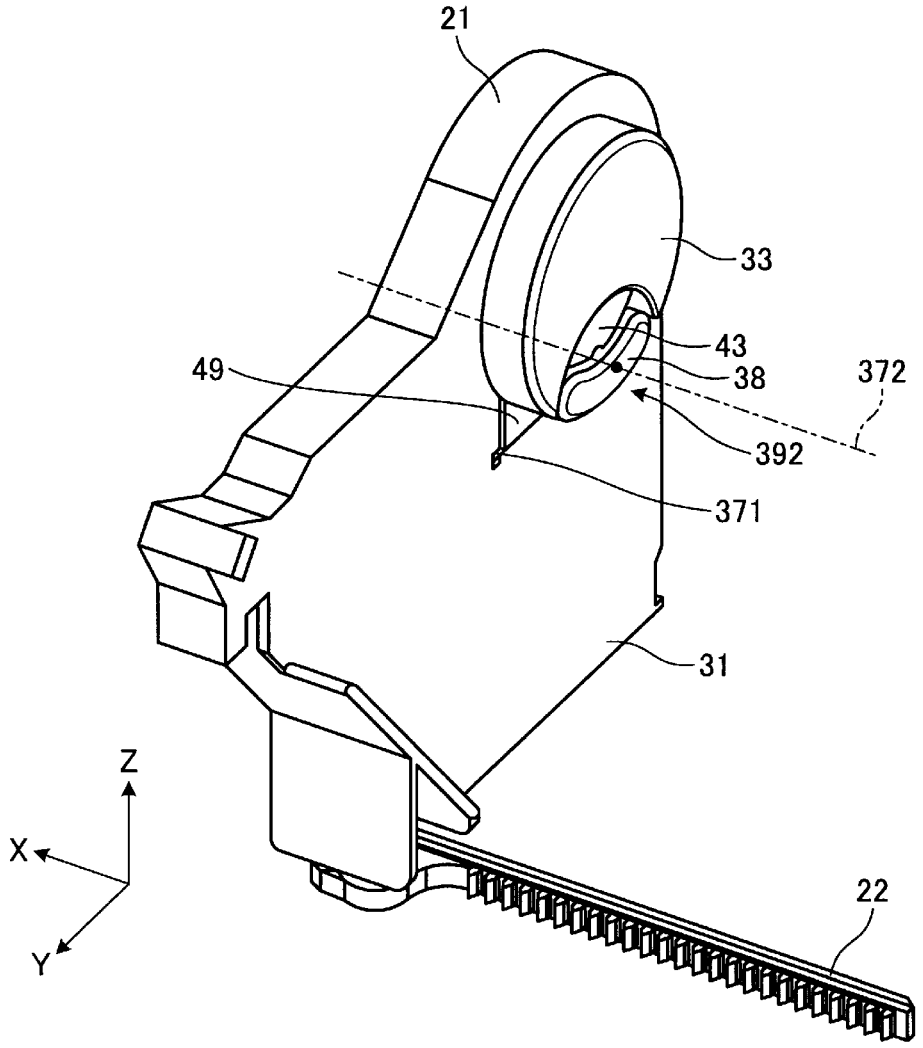
FIG. 11 is a diagram relating to a second embodiment and illustrating an example of a state in which a first core section can be supported by a first projecting section.
Figure 12:
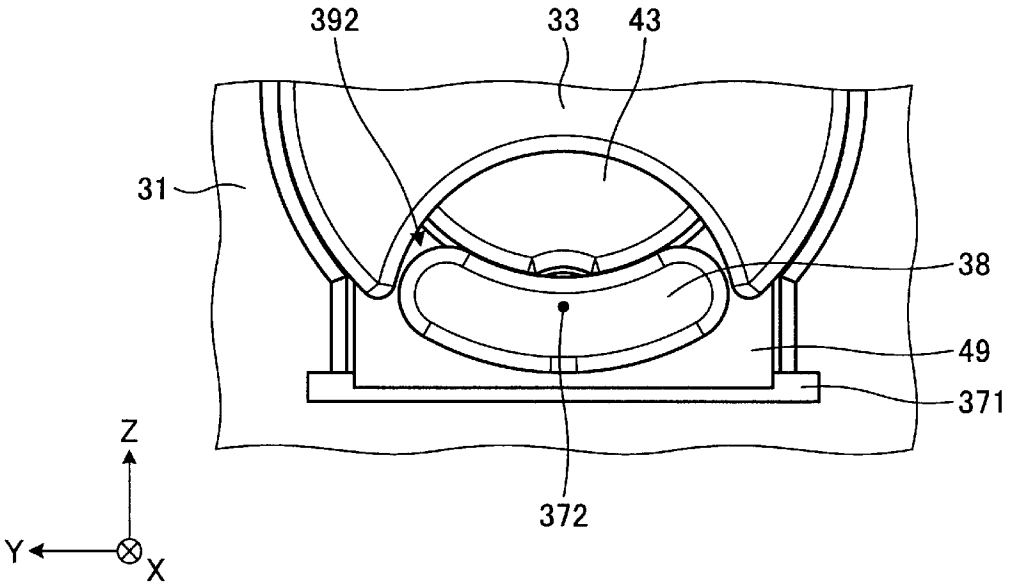
FIG. 12 is a diagram illustrating an example in which the first projecting section and a U-shaped second projecting section are enlarged in FIG. 11.

FIG. 11 is a diagram illustrating a state in which a first core section is supportable by the first projecting section 33. FIG. 12 is a diagram illustrating an example in which the first projecting section 33 and a U-shaped second projecting section 38 are enlarged in FIG. 11. As illustrated in FIGS. 11 and 12, the U-shaped second projecting section 38 has a curved surface shape for smoothly supporting the first core section on a side surface forming the circular outer edge in conjunction with the first projecting section 33. The U-shaped second projecting section 38 has a curved surface shape for smoothly supporting the second core section at both end portions of the U-shaped second projecting section 38.

As illustrated in FIGS. 11 and 12, the first projecting section 33 has a concave shape capable of storing the U-shaped second projecting section 38 and not interfering with the U-shaped second projecting section 38. The concave shape in the first projecting section 33 is equivalent to a storing section. A storing position 392 of the U-shaped second projecting section 38 corresponds to a position where the U-shaped second projecting section 38 is stored in a region having a concave shape at the lower end of the first projecting section 33 as illustrated in FIGS. 11 and 12. The U-shaped second projecting section 38 is stored in the storing position 392 forming a circular outer edge in conjunction with the first projecting section 33 at the lower end of the first projecting section 33.

The guide section 21 includes the first projecting section 33 and the holding section 43. The holding section 43 is disposed in a position corresponding to the concave shape in the first projecting section 33. As illustrated in FIGS. 11, 12, 14, and 15, the holding section 43 restricts turning of the U-shaped second projecting section 38. The guide section 21 supports a connecting member 49 to be capable of turning with the Y axis as a rotation axis (hereinafter referred to as first rotation axis) 371. The connecting member 49 supports the U-shaped second projecting section 38 to be capable of rotating around an axis (hereinafter referred to as second rotation axis) 372 that is orthogonal to an opposed surface opposed to the U-shaped second projecting section 38 and passes substantially the center of gravity of the U-shaped second projecting section 38.

Figure 13:
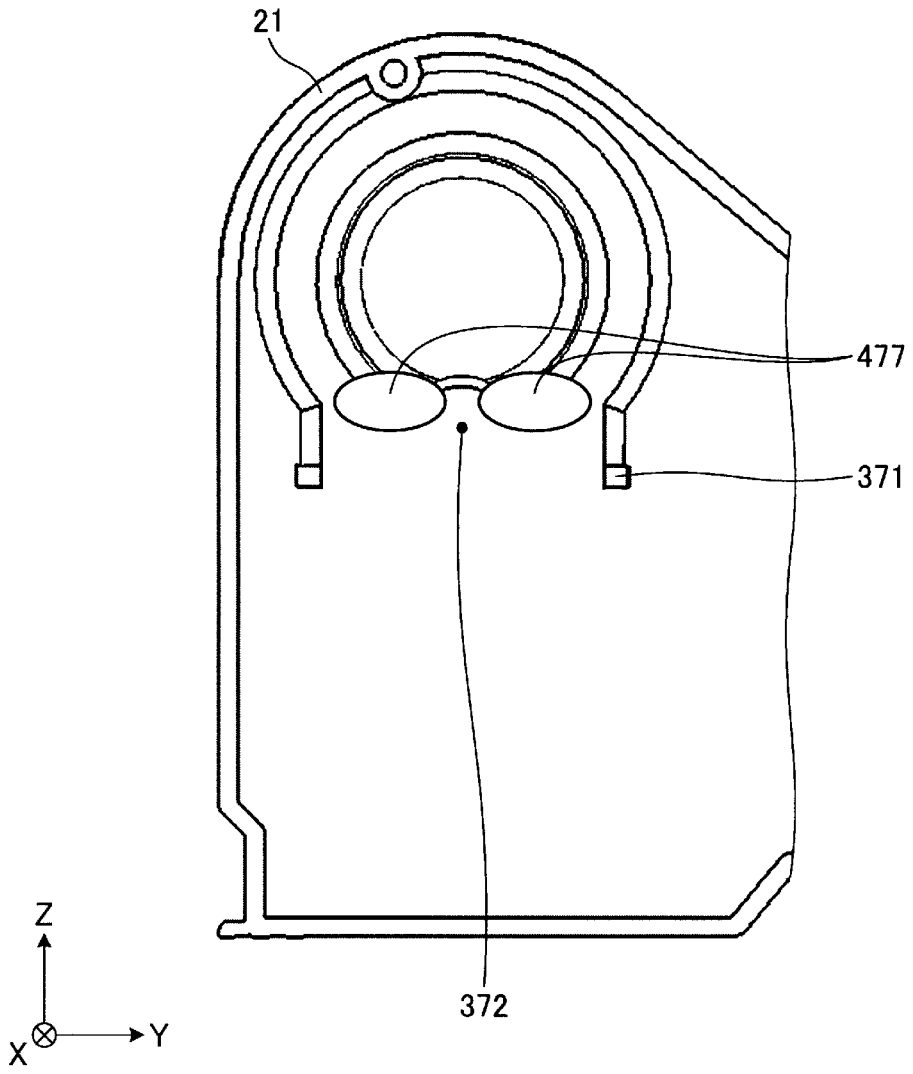
FIG. 13 is a diagram illustrating an example in which a guide section is viewed from a housing outside.

FIG. 13 is a diagram illustrating an example in which the guide section 21 is viewed from the outside of the guide surface 31, that is, a housing outside. As illustrated in FIG. 13, the guide section 21 includes an opening (hereinafter referred to as connecting opening) 477 accessible to the connecting member 49. The connecting member 49 turns around the first rotation axis 371 according to access of a user via the connecting opening 477. In this case, the connecting member 49 separates from the guide surface 31. Subsequently, the U-shaped second projecting section 38 rotates 180° around the second rotation axis 372 according to operation by the user. The connecting member 49 supporting the U-shaped second projecting section 38 rotated 180° is moved toward the guide surface 31 according to operation by the user. Consequently, the U-shaped second projecting section 38 is disposed in the supporting position 41 deviating to the outer side from the circular outer edge formed by the first projecting section 33.

Figure 14:
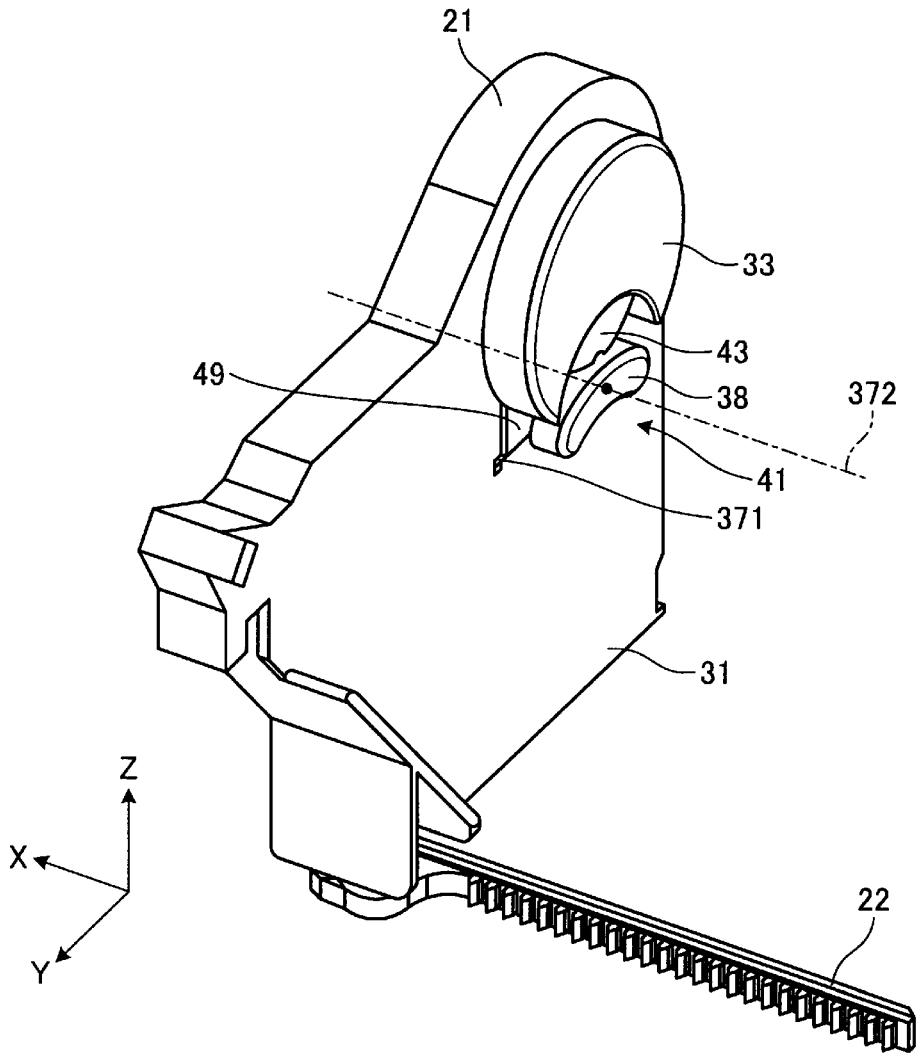
FIG. 14 is a diagram illustrating an example of the U-shaped second projecting section held in a supporting position.
Figure 15:
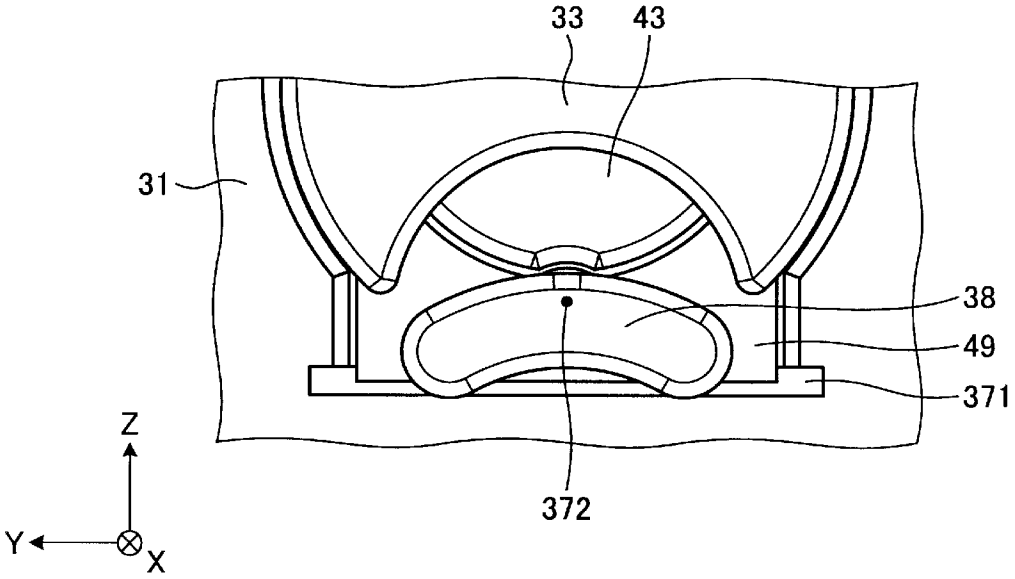
FIG. 15 is a diagram illustrating an example in which the first projecting section and the U-shaped second projecting section are enlarged in FIG. 14.

FIG. 14 is a diagram illustrating an example of the U-shaped second projecting section 38 held in the supporting position 41. FIG. 15 is a diagram illustrating an example in which the first projecting section 33 and the U-shaped second projecting section 38 are enlarged in FIG. 14. As illustrated in FIGS. 14 and 15, the holding section 43 restricts rotation of the U-shaped second projecting section 38. As illustrated in FIGS. 14 and 15, the U-shaped second projecting section 38 rotatably holds, in conjunction with the first projecting section 33, a second core section of another continuous paper having a core diameter larger than the core diameter of the continuous paper S held by the first projecting section 33.

As explained above, the printer device 1 according to the second embodiment includes the U-shaped second projecting section 38 rotatably holding, in conjunction with the first projecting section 33, the second core section of the other continuous paper having the core diameter larger than the core diameter of the continuous paper S held by the first projecting section 33. The U-shaped second projecting section 38 is movable between the storing position 392 forming the circular outer edge in conjunction with the first projecting section 33 at the lower end of the first projecting section 33 and the supporting position 41 deviating to the outer side from the circular outer edge formed by the first projecting section 33. Action effects in the second embodiment are the same as the action effects in the first embodiment. Therefore, explanation of the action effects is omitted.

Modification

Figure 16:
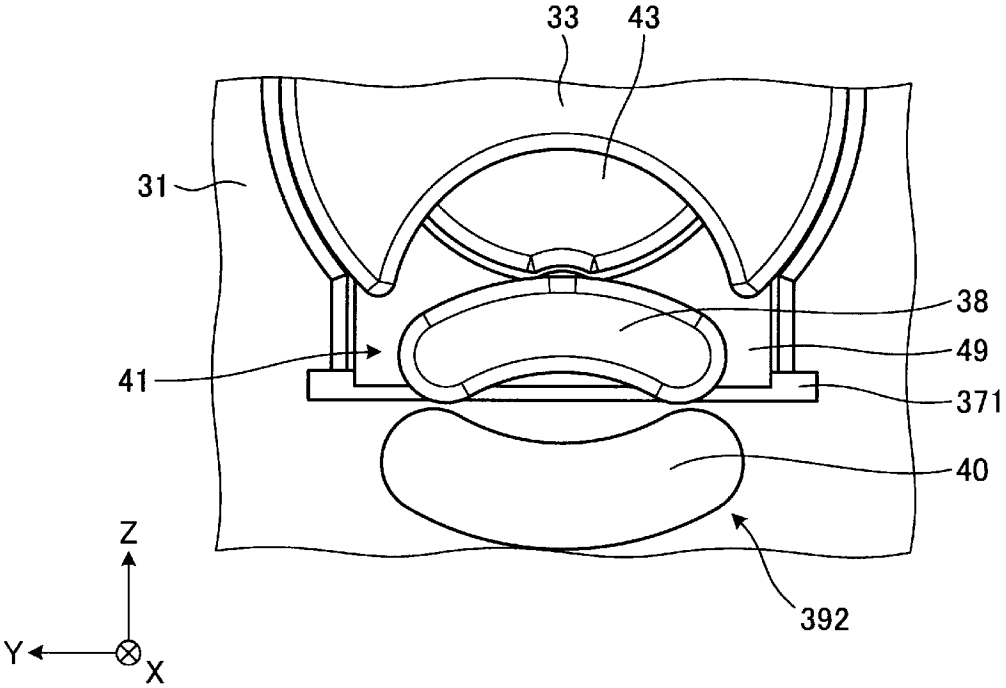
FIG. 16 is a diagram relating to a modification of the second embodiment and illustrating an example of the U-shaped second projecting section disposed in the supporting position and a storing section for the U-shaped second projecting section.

In a modification of the second embodiment, the guide section 21 does not have the second rotation axis 372 in the second embodiment and includes, further on the inner side than the guide surface 31, a storing section that stores the U-shaped projecting section 38. FIG. 16 is a diagram illustrating an example of the U-shaped second projecting section 38 disposed in the supporting position 41 and a storing section 40 for the U-shaped second projecting section 38. The storing section 40 is provided below the first projecting section 33 on the guide surface 31. The storing section 40 includes a region having a concave shape from the guide surface 31 toward a housing outside. The storing section 40 has a concave shape corresponding to the shape of the U-shaped second projecting section 38. The depth along the X direction of the concave shape is substantially equal to the height of the U-shaped second projecting section 38.

Figure 17:
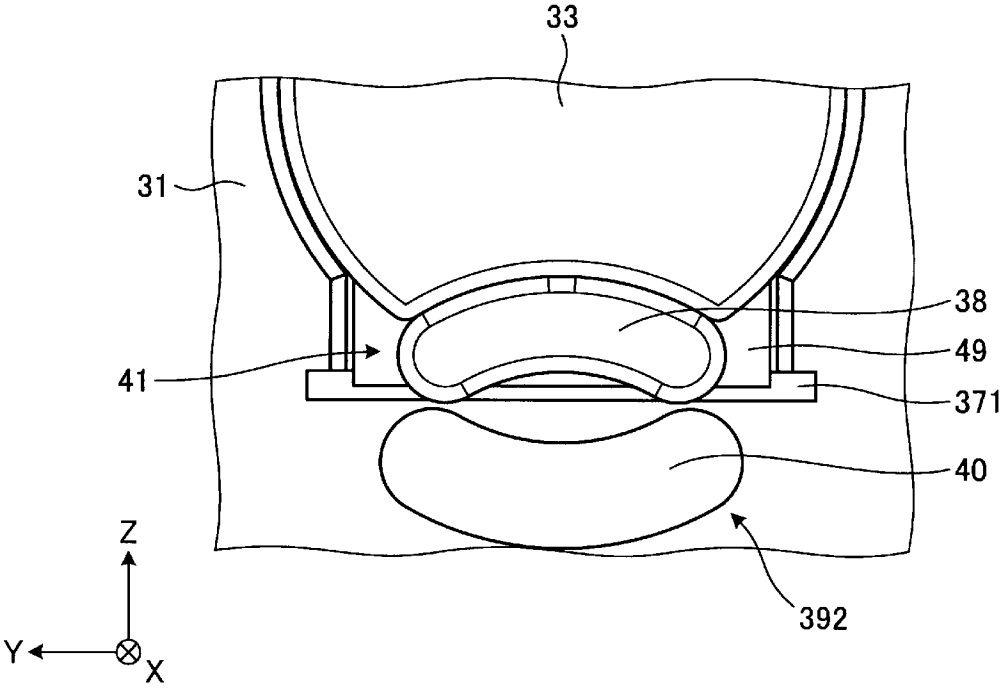
FIG. 17 is a diagram relating to the modification of the second embodiment and illustrating an example in which a holding section is not provided in FIG. 16.

As illustrated in FIG. 16, the movement of the U-shaped second projecting section 38 between the supporting position 41 and the storing position 392 of the U-shaped second projecting section 38 is realized by turning of the connecting member 49. As an application example of this modification, the holding section 43 may not be mounted on the guide section 21. FIG. 17 is a diagram illustrating an example in which the holding section 43 is not provided in FIG. 16. As illustrated in FIG. 17, the first projecting section 33 has a function of the holding section 43 as well. Action effects in the modification of the second embodiment are the same as the action effects in the first embodiment. Therefore, explanation of the action effects is omitted.

First Application Example

Figure 18:
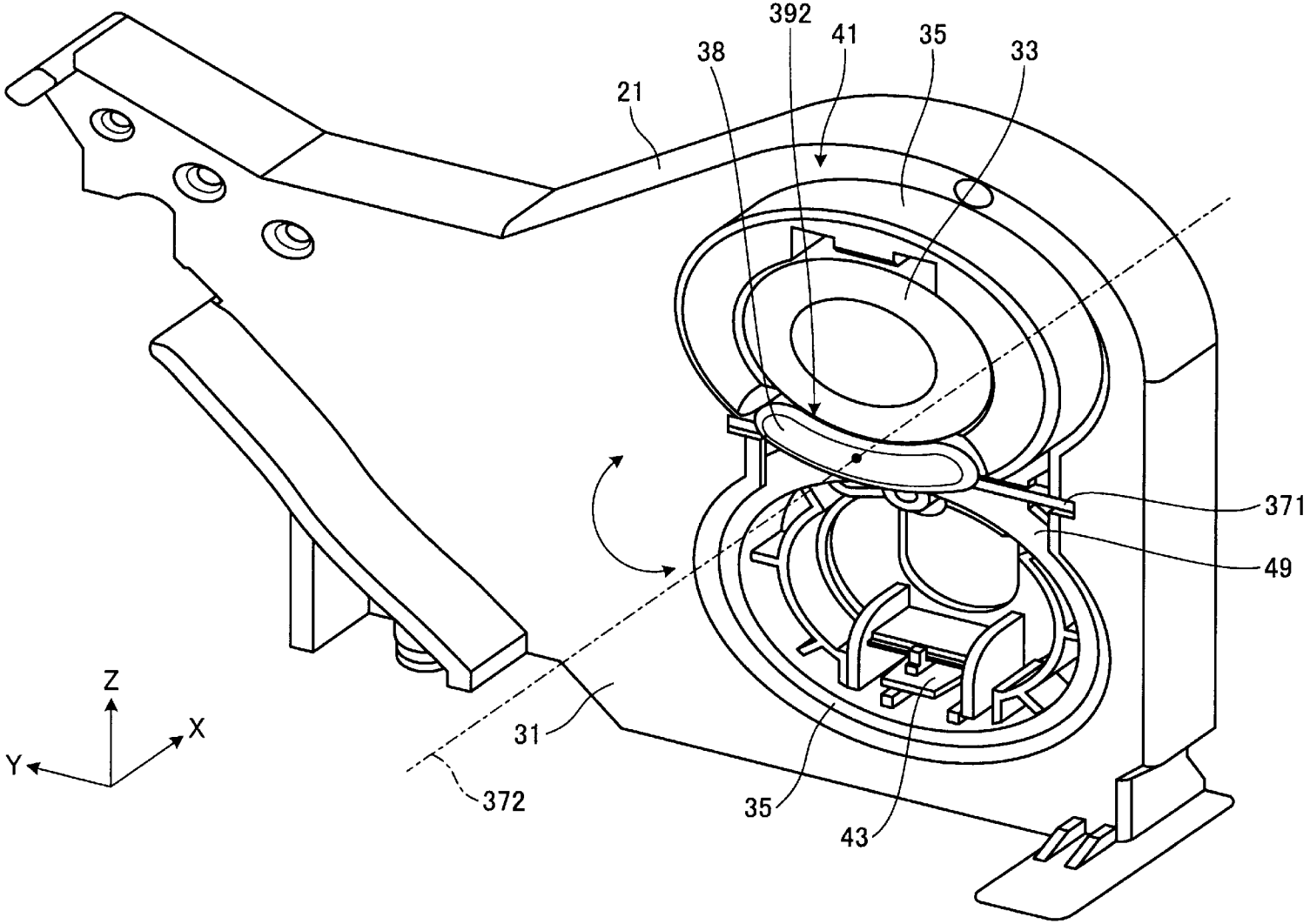
FIG. 18 is a diagram relating to a first application example of the embodiments and illustrating an example of the annular second projecting section and the U-shaped second projecting section.

In a first application example, the first embodiment and the second embodiment are combined. FIG. 18 is a diagram illustrating an example of an annular second projecting section 35 disposed in the supporting position 41 and the storing position 391 and the U-shaped second projecting section 38 disposed in the storing position 392. In FIG. 18, for convenience of explanation, the annular second projecting section 35 is disposed in the supporting position 41 and the storing position 391. However, actually, the annular second projecting section 35 is disposed in the supporting position 41 or the storing position 391. The annular second projecting section 35 and the U-shaped second projecting section 38 are mounted on the connecting member 49.

In the first application example, it is possible to support three kinds of core sections having different core diameters. For example, the first projecting section 33 supports a core section having a core diameter of 1 inch (approximately 25.4 mm). The annular second projecting section 35 supports, in the supporting position 41, for example, a core section having a core diameter of 1.5 inches (approximately 38 mm). Further, the U-shaped second projecting section 38 supports, in the supporting position, for example, in conjunction with the first projecting section 33, a core section having a core diameter of 42 mm. Operation, structure, and action effects in the first application example are the same as the operation, the structure, and the action effects in the first embodiment and the second embodiment. Therefore, explanation of the operation, the structure, and the action effects is omitted.

Second Application Example

Figure 19:
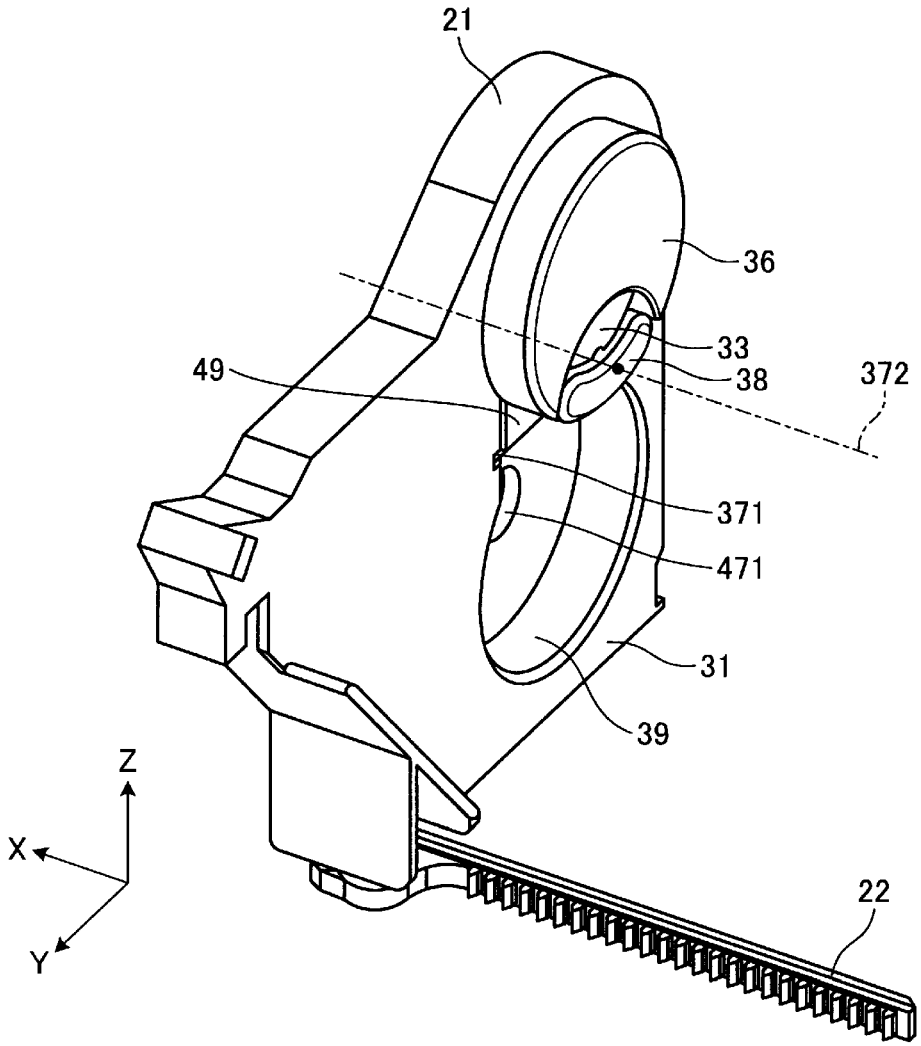
FIG. 19 is a diagram relating to a second application example of the embodiments and illustrating an example of the covering second projecting section and the U-shaped second projecting section.
Figure 20:
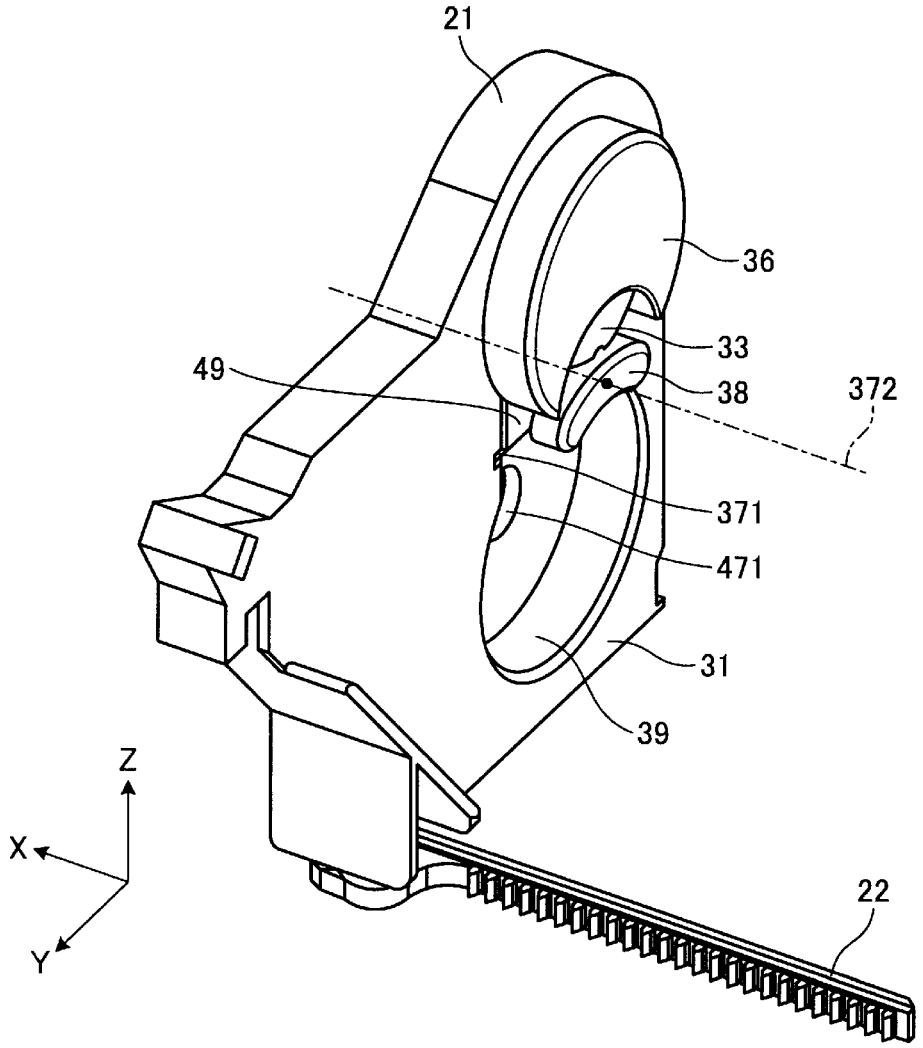
FIG. 20 is a diagram relating to the second application example of the embodiments and illustrating an example of the U-shaped second projecting section disposed in the supporting position.
Figure 21:
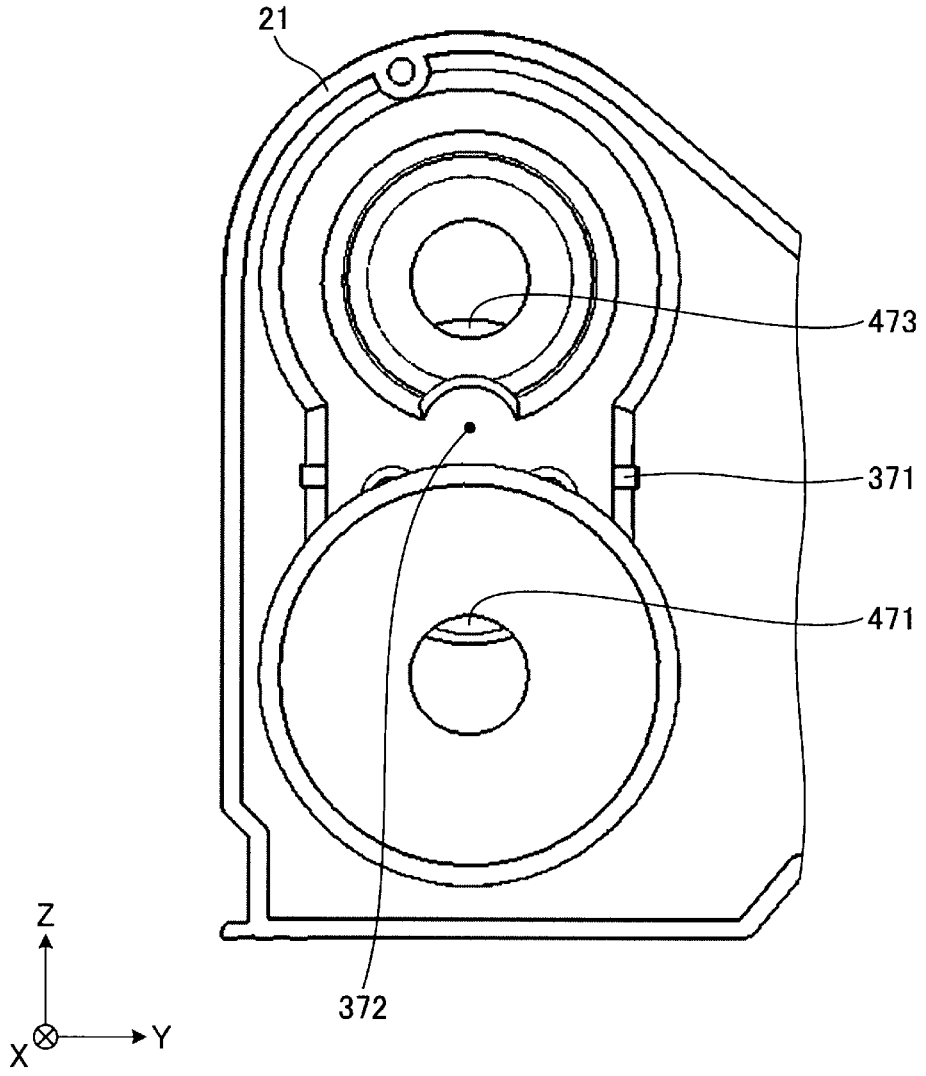
FIG. 21 is a diagram relating to the second application example of the embodiments and illustrating an example of the guide section viewed from the outside of a guide surface.

In a second application example, the modification of the first embodiment and the second embodiment are combined. The second application example is explained below with reference to FIGS. 8, 19, and 20. FIG. 19 is a diagram illustrating an example of the covering second projecting section 36 and the U-shaped second projecting section 38. FIG. 20 is a diagram illustrating an example of the U-shaped second projecting section 38 disposed in the supporting position 41. FIG. 21 is a diagram illustrating an example in which the guide section 21 is viewed from the outside of the guide surface 31. As illustrated in FIG. 21, the guide section 21 includes the supporting opening 473 corresponding to the supporting position 41 concerning the covering second projection section 36 and the storing opening 471 corresponding to the storing position 391 concerning the covering second projecting section 36.

In the second application example, as in the first application example, it is possible to support three kinds of core sections having different core diameters. For example, as illustrated in FIG. 8, the first projecting section 33 supports a core section having a core diameter of 1 inch (approximately 25.4 mm). As illustrated in FIG. 19, the covering second projecting section 36 supports, for example, a core section having a core diameter of 1.5 inches (approximately 38 mm). Further, as illustrated in FIG. 20, the U-shaped second projecting section 38 supports a core section having a core diameter of 42 mm. Operation, structure, and action effects in the second application example are the same as the operation, the structure, and the action effects in the modification of the first embodiment and the second embodiment. Therefore, explanation of the operation, the structure, and the action effects is omitted.

The several embodiments are explained above. However, these embodiments are presented as examples and are not intended to limit the scope of the invention. These new embodiments can be implemented in other various forms. Various omissions, substitutions, and changes can be made without departing from the spirit of the invention. These embodiments and modifications of the embodiments are included in the scope and the gist of the invention and included in the inventions described in claims and the scope of equivalents of the inventions.

What is claimed is:

1. A printer device, comprising:

a guide section disposed to be opposed to a side surface of roll-like continuous paper and including a guide surface for restricting movement of the roll-like continuous paper along a width direction of the roll-like continuous paper while unrolling the roll-like continuous paper;

a first projection on the guide surface side of the guide section and rotatably holding a core section of the roll-like continuous paper; and a second projection having an outer diameter larger than an outer diameter of the first projection and movable between a supporting position where the second projection contains an outer circumference of the first projection and a storing position where the second projection is stored further on an inner side than the guide surface, wherein in the supporting position, the second projection rotatably holds a core section of another roll-like continuous paper having a core diameter larger than a core diameter of the roll-like continuous paper.

2. The printer device according to claim 1, wherein the guide section supports the second projection so that the second projection is configured to turn between the storing position and the supporting position.

3. The printer device according to claim 1, wherein the guide section includes an opening in the storing position or the supporting position.

4. The printer device according to claim 1, wherein the guide section includes a holding section holding the second projection in the storing position or the supporting position.

5. The printer device according to claim 1, wherein the first projection projects in a convex shape.

6. The printer device according to claim 1, wherein the second projection has a hollow structure containing the first projection.

7. The printer device according to claim 1, wherein the second projection projects in a convex shape from the guide surface.

8. The printer device according to claim 1, wherein the printer device is configured to hold a plurality of roll-like continuous papers having different inner diameters of core sections.

9. A printer device, comprising:

a guide section disposed to be opposed to a side surface of roll-like continuous paper and including a guide surface for restricting movement of the roll-like continuous paper along a width direction of the roll-like continuous paper while unrolling the roll-like continuous paper;

a first projection provided on the guide surface side of the guide section and rotatably holding a core section of the roll-like continuous paper; and a second projection movable between a storing position where the second projection forms a circular outer edge in conjunction with the first projection at a lower end of the first projection or a storing position where the second projection is stored further on an inner side than the guide surface and a supporting position deviating to an outer side from the circular outer edge formed by the first projection, wherein in the supporting position, the second projection rotatably holds, in conjunction with the first projection, a core section of another roll-like continuous paper having a core diameter larger than a core diameter of the roll-like continuous paper.

10. The printer device according to claim 9, wherein the guide section supports the second projection so that the second projection is configured to turn between the storing position and the supporting position.

11. The printer device according to claim 9, wherein the guide section includes an opening in the storing position or the supporting position.

12. The printer device according to claim 9, wherein the guide section includes a holding section holding the second projection in the storing position or the supporting position.

13. The printer device according to claim 9, wherein the first projection projects in a convex shape.

14. The printer device according to claim 9, wherein the second projection has a hollow structure containing the first projection.

15. The printer device according to claim 9, wherein the second projection projects in a convex shape from the guide surface.

16. The printer device according to claim 9, wherein the printer device is configured to hold a plurality of roll-like continuous papers having different inner diameters of core sections.

17. A printer device, comprising:

a guide section disposed to be opposed to a side surface of roll-like continuous paper and including a guide surface for restricting movement of the roll-like continuous paper along a width direction of the roll-like continuous paper while unrolling the roll-like continuous paper;

a first projection on the guide surface side of the guide section and rotatably holding a core section of the roll-like continuous paper; and a second projection having an outer diameter larger than an outer diameter of the first projection and movable between a supporting position where the second projection contains an outer circumference of the first projection and a storing position where the second projection is stored further on an inner side than the guide surface, wherein in the supporting position, the second projection rotatably holds a core section of another roll-like continuous paper having a core diameter larger than a core diameter of the roll-like continuous paper, the printer device is configured to hold a plurality of roll-like continuous papers having different inner diameters of core sections.

18. The printer device according to claim 17, wherein the guide section supports the second projection so that the second projection is configured to turn between the storing position and the supporting position.

19. The printer device according to claim 17, wherein the guide section includes an opening in the storing position or the supporting position.

20. The printer device according to claim 17, wherein the guide section includes a holding section holding the second projection in the storing position or the supporting position.

* * * * *